US005252027A

United States Patent [19]

Brasz

[11] Patent Number: 5,252,027

[45] Date of Patent: Oct. 12, 1993

[54] PIPE DIFFUSER STRUCTURE

[75] Inventor: Joost J. Brasz, Fayetteville, N.Y.

[73] Assignee: Carrier Corporation, Syracuse, N.Y.

[21] Appl. No.: 869,081

[22] Filed: Apr. 14, 1992

Related U.S. Application Data

[62] Division of Ser. No. 605,619, Oct. 29, 1990, Pat. No. 5,131,142.

[51] Int. Cl.[5] ..... F01D 1/06

[52] U.S. Cl. ..... 415/224.5

[58] Field of Search ..... 415/224.5, 208.1, 208.2, 415/208.3

[56] References Cited

U.S. PATENT DOCUMENTS

| | | | |
|---|---|---|---|
| 3,604,818 | 9/1971 | Cronstedt | 415/208.3 |
| 3,737,247 | 6/1973 | Horning | 415/208.3 |
| 3,743,436 | 7/1973 | O'Connor | 415/208.3 |
| 3,778,186 | 12/1973 | Bandukwalla | 415/208.3 |
| 3,905,721 | 9/1975 | Fitzpatrick | 415/208.3 |
| 3,930,746 | 1/1976 | Kronogard | 415/208.3 |
| 3,964,837 | 6/1976 | Exley | 415/208.3 |
| 4,302,150 | 11/1981 | Wieland | 415/208.3 |
| 5,145,317 | 9/1992 | Braz | 415/224.5 |

*Primary Examiner*—John T. Kwon

[57] ABSTRACT

A pipe diffuser is formed from a disc by initially drilling a plurality of circumferentially spaced, generally radially extending passages, but not to the point of any substantial intersection between the adjacent passages. Material is then removed by forming a circumferential groove on the inner periphery of the disc to the radial extent of a leading edge circle defined by the leading edges of the islands between the passages. The radial cross-sectional shape of the circumferential groove can be rectangular in form, in which case that space becomes fully vaneless, or it may be arcuate in form, in which case the space will be semi-vaneless. A preferred shape is one in which the groove is semi-elliptical in form so as to provide a structure that is substantially equivalent to the prior art structure while being easier to manufacture.

6 Claims, 5 Drawing Sheets

PIPE DIFFUSER STRUCTURE

This application is a division of application Ser. No. 07/605,619 filed Oct. 29, 1990, now U.S. Pat. No. 5,131,142 issued Jul. 21, 1992.

BACKGROUND OF THE INVENTION

This invention relates generally to centrifugal compressors and, more particularly, to a method of making a pipe diffuser therefor.

Pipe diffusers, such as are shown and described in U.S. Pat. No. 3,333,762 issued to J.C. Vrana on Aug. 1, 1967, have long been used with centrifugal compressors in aircraft engines. Typically, an array of generally radially extending passages are circumferentially spaced and angled from the radial direction such that their center lines are all tangent to the same circle, referred to as the tangency circle. The geometry is such that, at the point where the passages mutually intersect, a semi-vaneless space is formed between the tangency circle and an outer circle called the leading edge circle. Since the intersection of adjacent coplanar cylinders is an ellipse, this semi-vaneless space is composed of an array of symmetrically located elliptical ridges at the intersections. When the diffuser structure is placed around a centrifugal impeller, the flow exiting from the impeller will enter at the tangency circle, flow through the semi-vaneless space, and then enter the plurality of discrete passages in the diffuser.

The aerodynamic merit of such a diffuser concept is that of obtaining an optimum aspect ratio and therefore relatively high efficiency. A feature of such a pipe diffuser structure is that the individual passages must extend radially inwardly to the extent that they intersect. The problem encountered during the drilling process is that as the drill commences to enter the adjacent passages, it tends to wander from the intended straight path along its axis. A typical method of dealing with this problem is to use metal plugs to fill the previously drilled holes so as to thereby present a uniform, solid medium, environment in the intersection area. After all the passages have been drilled, and the material disposed radially inside the tangency circle is removed, the metal plugs can be removed. However, such a process tends to be expensive in terms of time and material that are required.

It is therefore an object of the present invention to provide an improved method of making a pipe diffuser.

Another object of the present invention is the provision in a pipe diffuser for making the diffuser channels in an accurate and economical manner.

Yet another object of the present invention is the provision for a pipe diffuser which is economical to manufacture and effective in use.

These objects and other features and advantages become more readily apparent upon reference to the following description when taken in conjunction with the appended drawings.

SUMMARY OF THE INVENTION

Briefly, and in accordance with one aspect of the invention, the extent to which the individual passages extend radially inwardly is limited such that adjacent passages do not substantially intersect. The radially inner edge material is then removed not only up to the tangency circle but all the way out to the leading edge circle. The result is that, rather than having a semi-vaneless space between the tangency circle and the leading edge circle, there is a fully vaneless space in that area. The structure which is disposed radially outward of the leading edge circle, however, is identical to that of the prior art. The resulting structure is therefore substantially equivalent, functionally, to the prior art structure but it is easier and more economical to manufacture.

By another aspect of the invention, the removal of material at the radially inner edge is accomplished by the use of an elliptical cutter, wherein a circumferential groove, centered at the center of the diffuser and having a semi-elliptical radial profile, is formed between the tangency circle and the leading edge circle with said groove having a width equal to the diameter of the interconnecting passages and a depth equal to the difference of radii between the leading edge circle and the tangency circle.

In the drawings as hereinafter described, a preferred and modified embodiments are depicted; however, various other modifications and alternate constructions can be made thereto without departing from the true spirit and scope of the invention.

DESCRIPTION OF THE PREFERRED EMBODIMENT

The present invention relates to a diffuser apparatus and method of forming the internal passages in the diffuser structure as shown and described in U.S. patent application Ser. No. 07/605,620 assigned to the assignee of the present invention and incorporated herein by reference.

Figure 1:
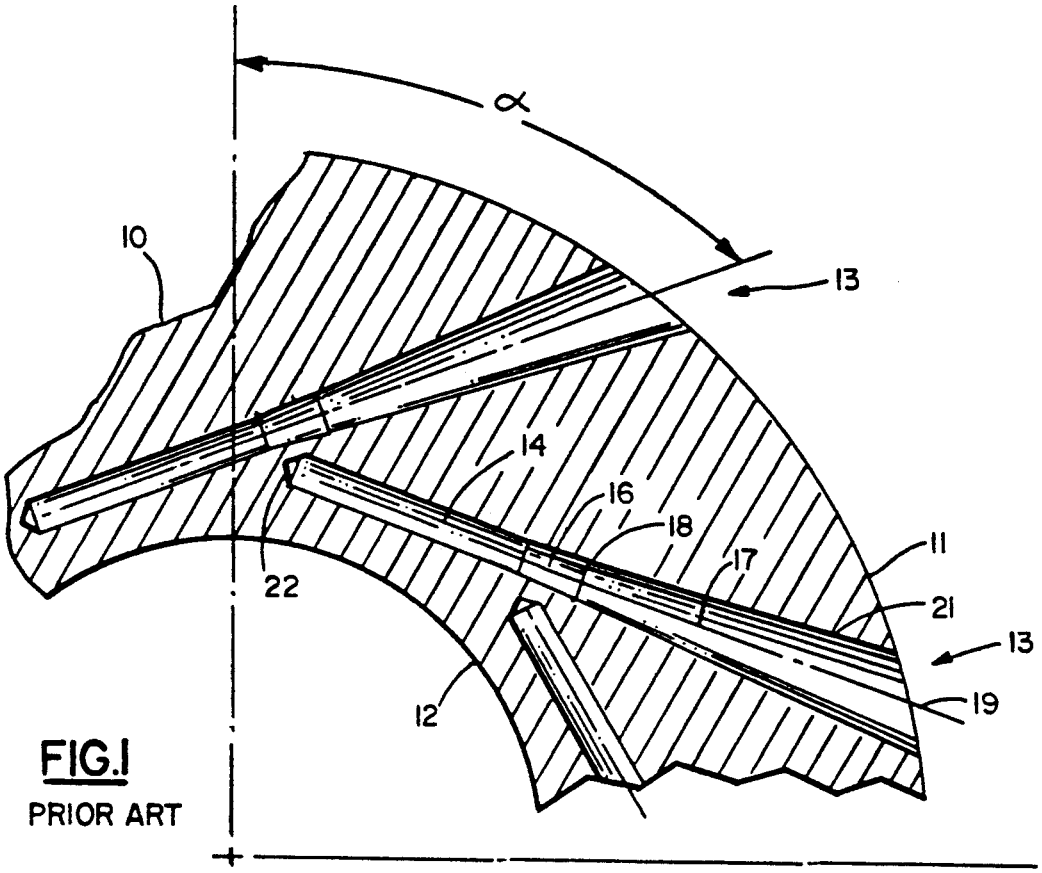
FIG.1 PRIOR ART
FIGS. 1–4 are partial, axial cross-sectional views of a diffuser being fabricated in accordance with a prior art method.
Figure 2:
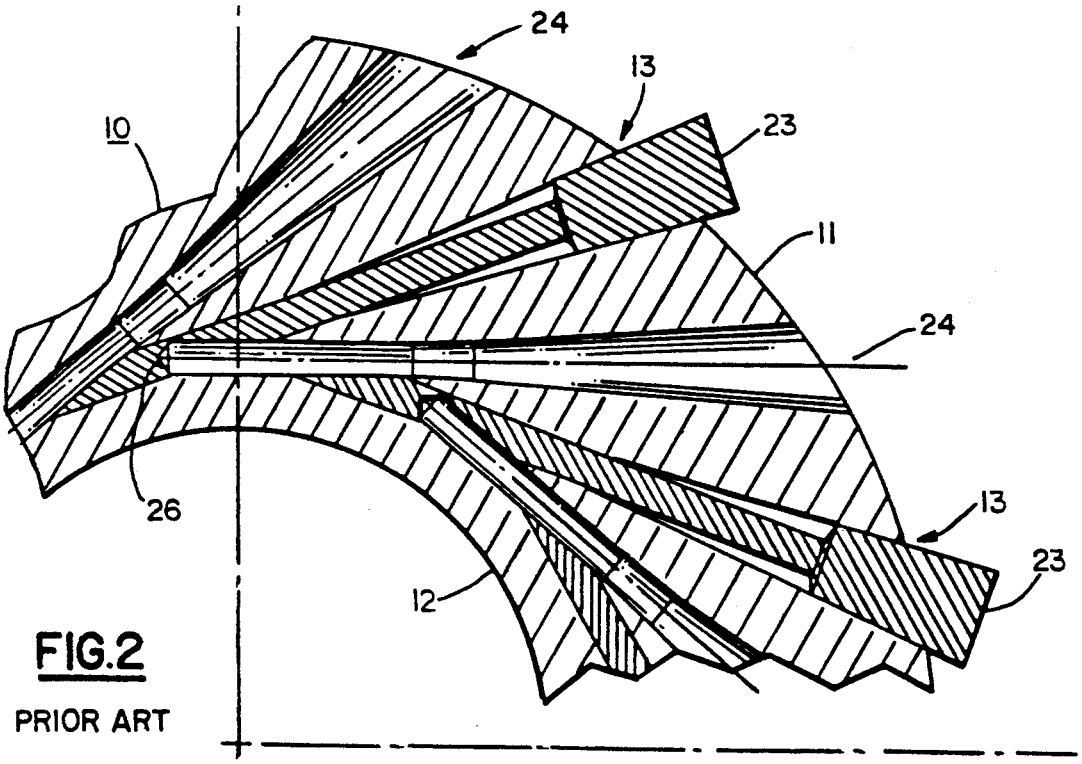
FIG.2 PRIOR ART

Referring to FIG. 1, a segment of the disc-like diffuser structure 10 is shown in axial cross section as having an outer circular edge 11 which, in the assembled condition, is located within the volute or collector (not shown), and an inner circular edge 12 which, in the assembled condition, closely surrounds the impeller (not shown) which discharges compressed refrigerant to the internal passages of the diffuser 10. The diffuser to be described is a so called "pipe diffuser" having a plurality of circumferentially spaced, generally radially aligned, frustro-conical passages formed therein for allowing the compressed gases to expand as they travel from the smaller to the larger ends of the passages to thereby convert the kinetic energy of the refrigerant gas to a potential energy or static pressure. However, it should be recognized that the present invention is equally applicable to a vane or channel type diffuser wherein, rather than the passages being circular in cross section, they may be another shape such as rectangular with wedge shaped islands disposed therebetween.

As a first step in the prior art machining process, half of the required number of radial passages are formed by a drilling process as shown in FIG. 1. That is, every other one of the required passages is drilled in a generally radial direction, but at a prescribed angle to the radial direction. Each of the passages 13 is formed of three serially connected portions 14, 16, 17, with the first, 14, being cylindrical in form, the second, 16, being frustro-conical with the walls 18 being disposed at a first angle (e.g. 2 degrees) with the axis 19, and a third portion 17 being frustro-conical in form with its walls 21 being disposed at a larger angle (e.g. 4 degrees) with the axis 19. It will be seen that the internal ends 22 of the passages 13 stop short of intersecting with the adjacent passages.

The next step in the prior art method is to insert into each of the formed passages 13, a plug 23 made from a suitable material preferably one having the same machinability characteristics as that of the diffuser itself. The remaining passages 24 are then formed in an alternate relationship between the passages 13 as shown. The plugs 23 allow the passages 24 to be drilled without the drill bit tending to drift when it reaches the point of intersection with the adjacent passage 13. That is, as each of the alternate passages 24 are drilled, they intersect with the passages 13 on either side thereof but, because of the presence of the plugs within those spaces, the drill is always surrounded by solid material and is not allowed to drift from its straight line drilling path.

Figure 3:
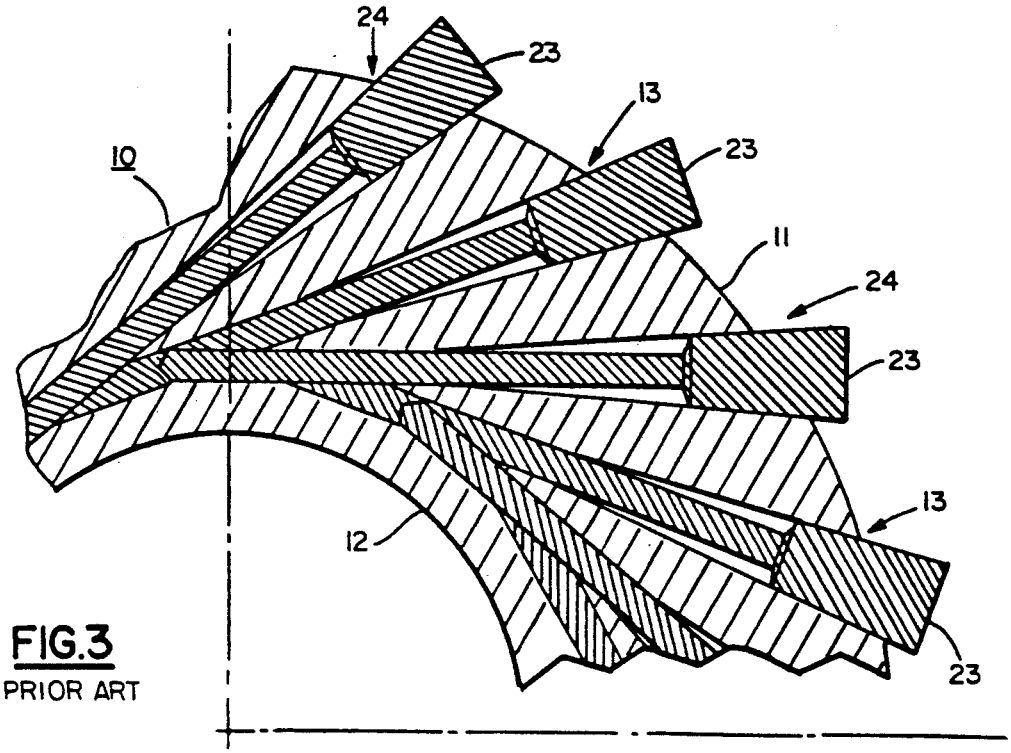
FIG.3 PRIOR ART
Figure 4:
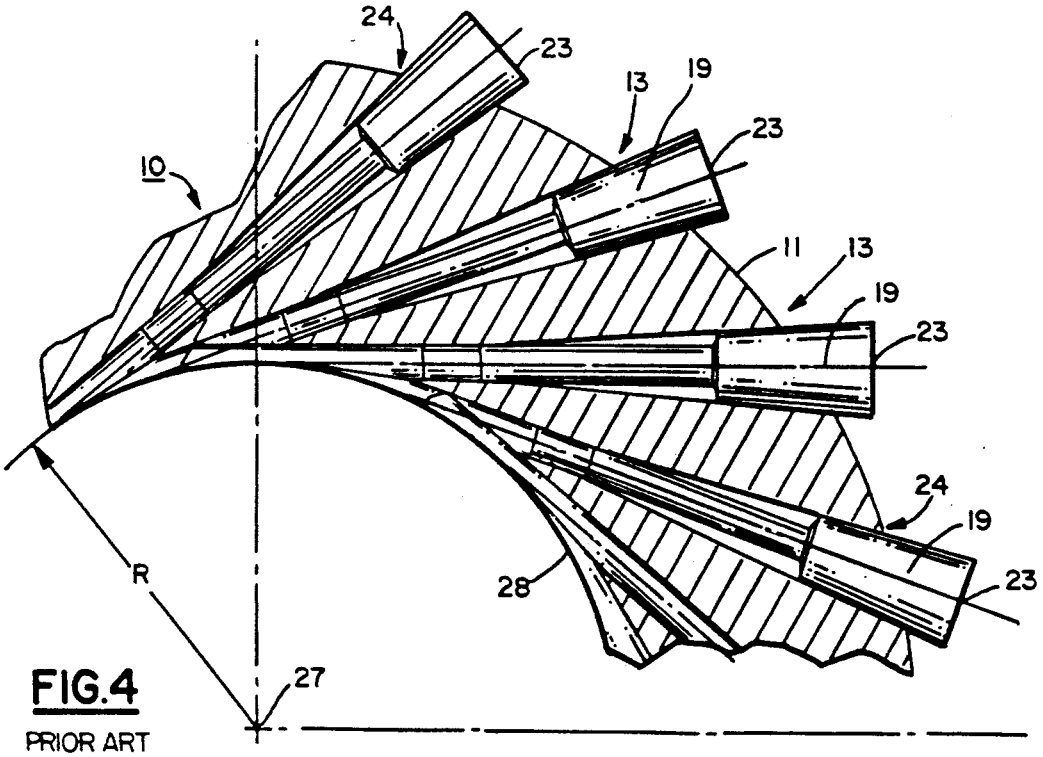
FIG.4 PRIOR ART

Just as in the filling of the passages 13 by use of the plugs 23 to provide a solid medium in which to conduct the drilling process, in order to properly machine the inner periphery 12 of the diffuser structure 10 it is necessary to insert plugs 23 in the newly formed passages 24 such that all of the passages 13 and 24 were then filled with plugs at their inner ends. This step is shown in FIG. 3, and is done in preparation for the final machining step of the process, the results of which are shown in FIG. 4.

Figure 5:
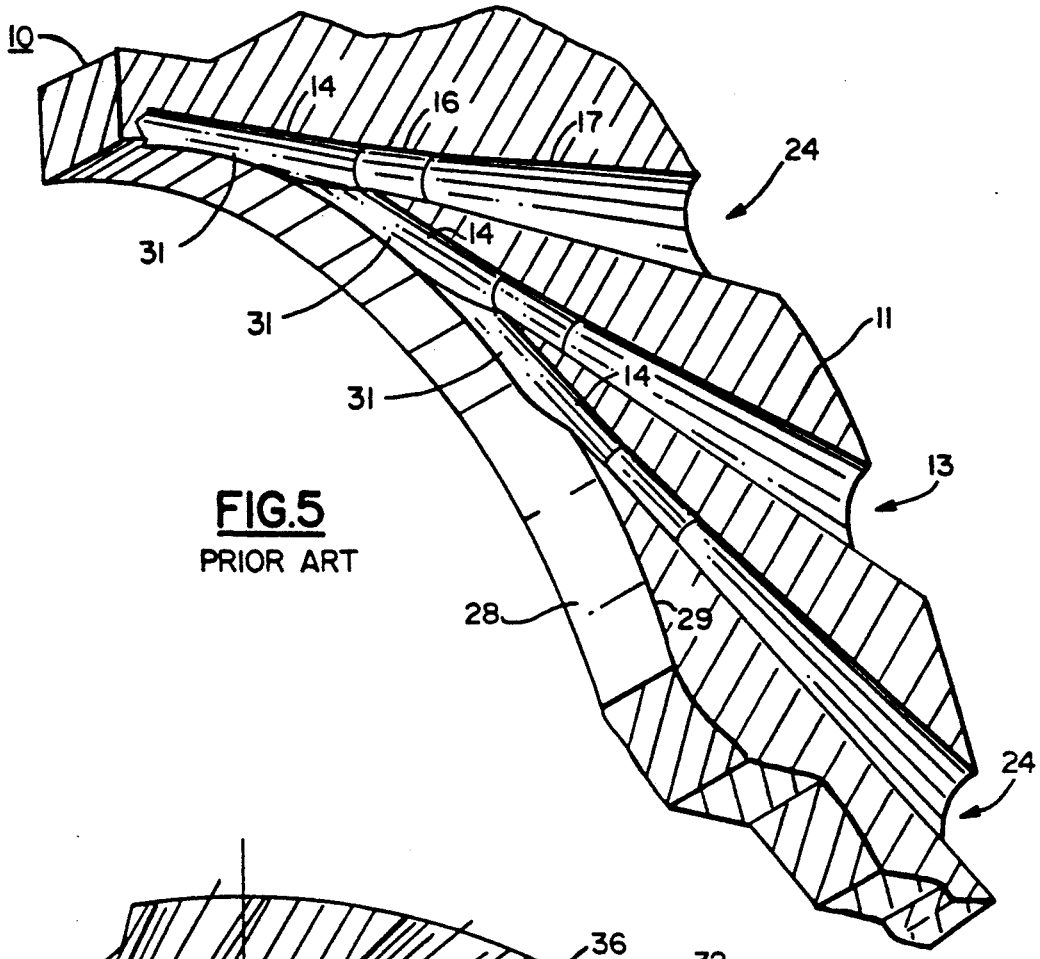
FIG.5 PRIOR ART
FIG. 5 is an isometric view of a portion thereof showing the formed passages.
Figure 6:
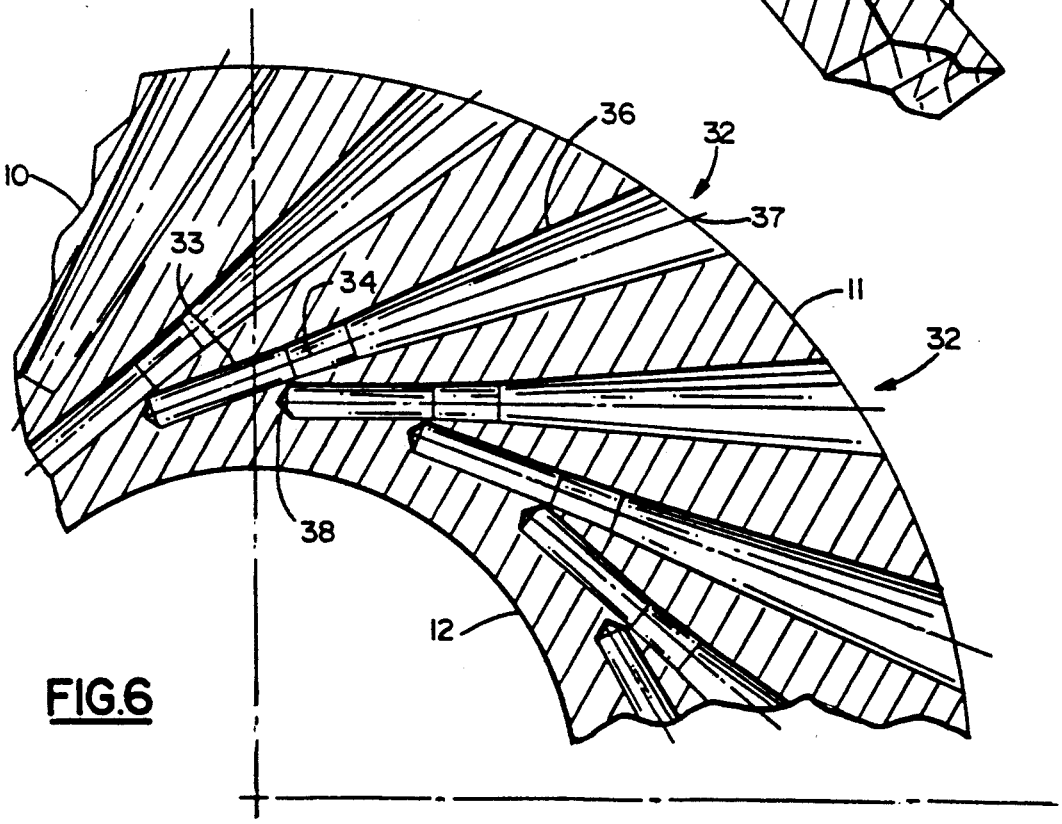
FIGS. 6–8 are partial, axial cross-sectional views of a diffuser as formed in accordance with the present invention.

As that final step, the inner edge 12 (see FIG. 3) is machined in a uniform circular manner about a center 27, with the radius R being equal to the radius of the tangency circle such that the final internal edge 28 is coincident with the tangency circle, to which the axes 19 of each of the passages 13 and 24 are in a tangential relationship. After the plugs 23 have been removed, the resulting diffuser 10 with its internal passages 13 and 24 will appear as shown in FIG. 5, with the final internal edge 28 incorporating a portion located generally on a circle 29 and having a plurality of tangential cyclindrical sections 31 which correspond to the linear side walls surfaces of the passages 13 and 24. The surfaces 31 are serially interconnected in circumferential relationship, with each section having an arcuate axial, cross sectional profile with the center of curvature on the axis of the passage, but which also remains parallel to the axis along its length.

It will be recognized that the above described prior art method is time consuming and expensive since a set of plugs 23 must be fabricated and used for each impeller that is machined, and the plugs are then not re-useable for the fabrication of subsequent impellers.

Figure 7:
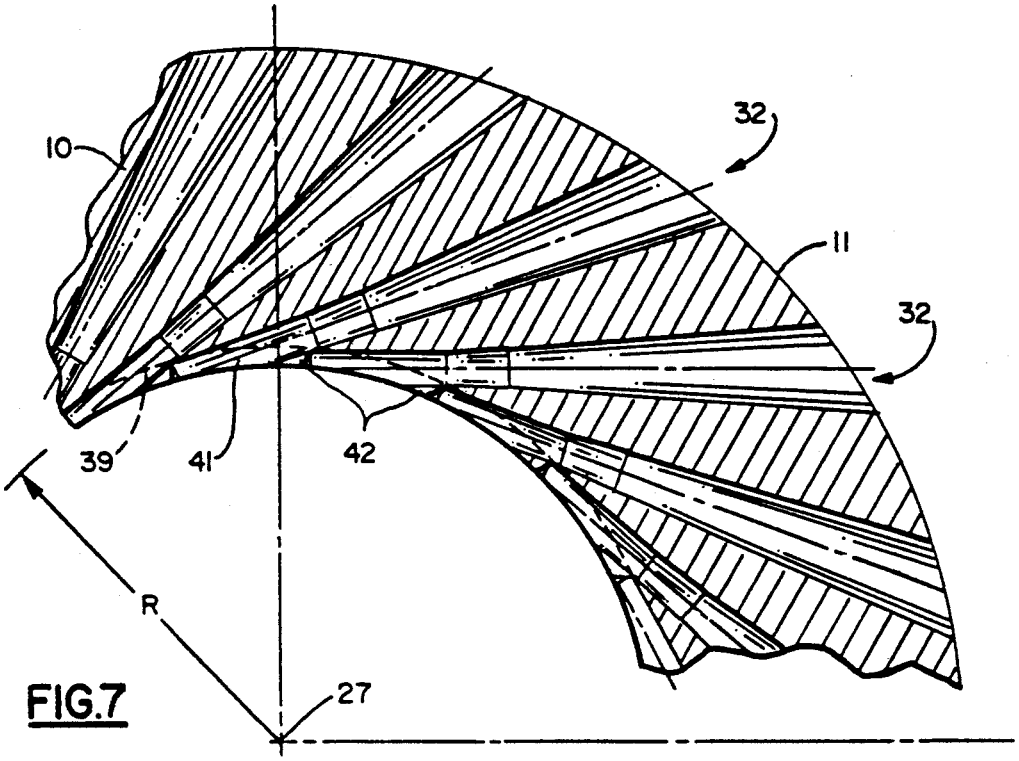

In accordance with the method of the present invention as shown in FIGS. 6–11, each of the passages 32 is formed in the diffuser disc 10, with each having a cylindrical section 33 and frustro-conical sections 34 and 36, all formed about an axis 37, as described hereinandabove. However, the axial depth of the passages 32 are limited such that the end 38 of the cylindrical section 33 extends only to the point where it touches but does not substantially intersect, the adjacent passage. This can be accomplished without incurring any drift of the drill bit. The next step is to remove the material from the inner surface 12 as is shown in FIG. 7.

In accordance with one embodiment of the invention, the material is removed uniformly from the inner edge to the radially outward extent of a leading edge circle indicated by the dotted line in 39. The result is that there is a fully vaneless space in the area bounded by the leading edge circle 39 and the tangency circle 41. Thus, radially outwardly from the leading edge circle 39 the structure of the diffuser shown in FIG. 7 is identical to that of the prior art structure. Internally from the leading edge circle 39, there is no vane structure in the FIG. 7 embodiment, while there is a semi-vaneless space in the prior art embodiment. Although the FIG. 7 embodiment is not functionally identical, it has been found to perform in a satisfactory manner and is much more easily fabricated than the prior art device.

Figure 8:
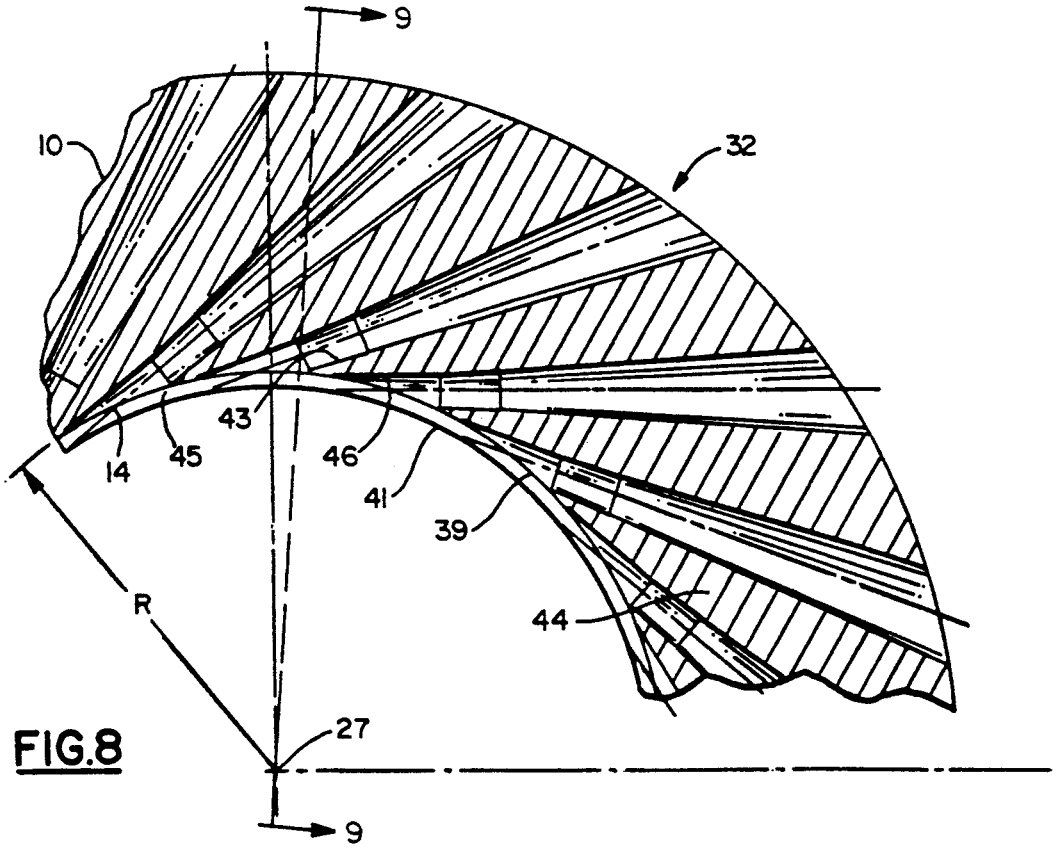
Figure 9:
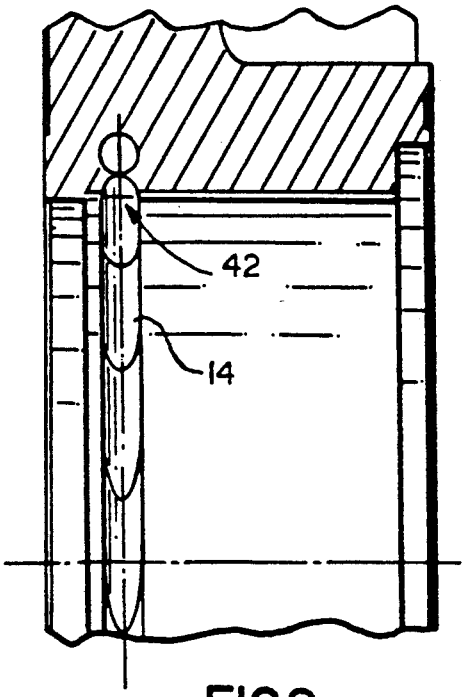
FIG. 9 is a cross sectional view of the diffuser thereof as seen along lines 9—9 of FIG. 8.

In order to more closely approximate the functional characteristics of the prior art apparatus, while still allowing for a much easier manufacturing process, the diffuser disk 10 is initially machined radially outwardly only to the tangency circle 41 as shown. This, as will be seen, leaves a plurality of triangular shaped (in axial cross section) islands 42 FIG. 7 at the entrances to the passages 32. This material therefore needs to be removed as shown in FIGS. 8 and 9.

Figure 10:
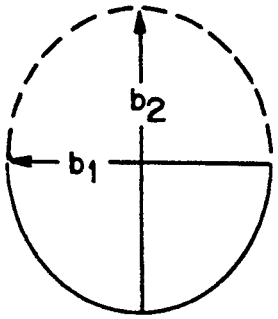
FIG. 10 is a schematic view thereof showing the dimensional relationship of the groove formed therein.
Figure 11:
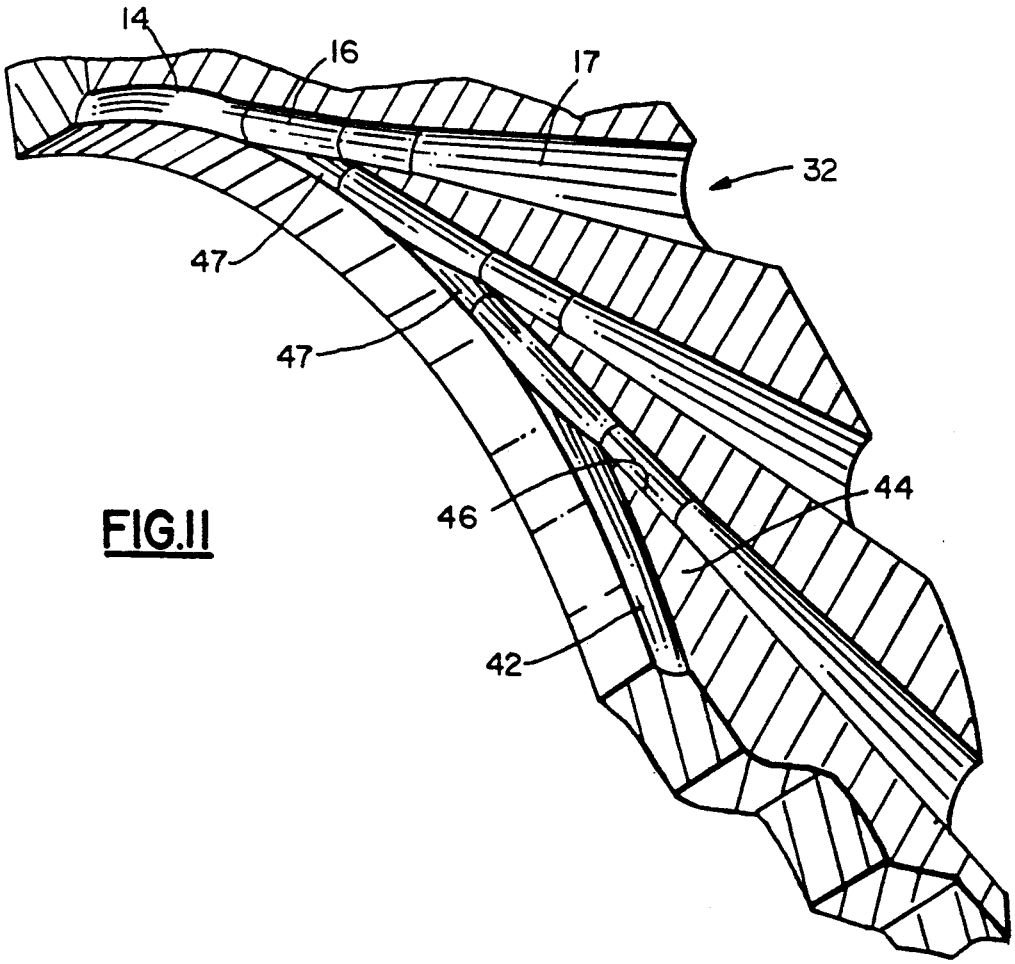
FIG. 11 is an isometric partial view of the diffuser resulting from the fabrication method of the present invention.

A cutter, rotating about the center 27 of the diffuser 10, is used to machine a circular groove 45 in the inner periphery, with the radial depth of the groove extending to the leading edge circle 39 as shown. The radial profile of the groove 45 can be rectangular, circular, or any other desired shape. However, the preferred shape is that of a semi-ellipse having the axes be $b_1$ and $b_2$ as indicated in FIG. 10, wherein $b_1$ is equal to the diameter of the cylindrical portion 14 of the passages and $b_2$ is equal to the difference between the diameters of the leading edge circle 39 and that of the tangency circle 41. Based on this definition $b_1$ and $b_2$ can be either minor or major axis of the semi-ellipse. The structure that is disposed radially outwardly of the leading edge circle i then identical to that of the prior art, and the structure between the tangency circle and the leading edge circle is identical on the pressure side-43 of the wedge shaped structure 44, and very closely approximates the structure and performance on the suction side 46 thereof. That is, on the suction side 46, instead of that surface being semi-cylindrical in form, with the center of curvature being on the axis of the passage 32, the surface has a semi-elliptical radial profile with its axial profile being circular in form with the center of curvature being at the center 27 of the diffuser. This can be seen in FIG. 11 wherein the annular groove 45 is shown. At the intersection of that groove 45 with the suction side 46 of the wedge shaped island 44 is a section 47 that is arcuate in form with its center of curvature being at the center 27 of the diffuser 10.

While the present invention has been disclosed with particular reference to preferred and modified embodiments, the concepts of this invention are readily adaptable to other embodiments, and those skilled in the art may vary the structure thereof without departing from the essential spirit of the present invention.

What is claimed is:

1. An improved diffuser of the type having a plurality of circumferentially spaced, generally radially extending, channels with wedge shaped islands therebetween, said channels having radial cross-sections which are round in form and having their axes aligned in tangential relationship to a tangency circle, and the leading edge of each of the islands coinciding with a leading edge circle located radially outwardly from said tangency circle; wherein a circumferentially extending groove is formed on an inner peripheral boundary coinciding with the leading edge circle, said groove being rectangular in radial cross-section such that the space between the tangency circle and the leading edge circle is fully vaneless.

2. A pipe diffuser as set forth in claim 1, wherein said channels have an axial cross-section that is tapered in form.

3. An improved diffuser of the type having a plurality of circumferentially spaced, generally radially extending, channels with wedge shaped islands therebetween, said channels having their axes aligned in tangential relationship to a tangency circle, and the leading edges of each of the islands coinciding with a leading edge circle located radially outwardly from said tangency circle; wherein said diffuser includes a circumferential groove formed on an inner peripheral boundary and having a plurality of circumferentially spaced and circumferentially extending portions located on the leading edge circle.

4. An improved diffuser as set forth in claim 3 wherein said groove is semi-elliptical in radial cross-sectional form.

5. An improved diffuser as set forth in claim 4 wherein said groove has a maximum width equal to a minimum diameter of said channel.

6. An improved diffuser as set forth in claim 4 wherein said groove has a radial depth that is equal to the difference between the radii of the tangency circle and the leading edge circle.

* * * * *